US006401617B1

(12) United States Patent
Lyndhurst

(10) Patent No.: US 6,401,617 B1
(45) Date of Patent: Jun. 11, 2002

(54) PRINTING PLATE LOCKUP MECHANISM

(76) Inventor: F. Richard Lyndhurst, 2885 San Miguel La., #A, Costa Mesa, CA (US) 95626

( * ) Notice: Subject to any disclaimer, the term of this patent is extended or adjusted under 35 U.S.C. 154(b) by 0 days.

(21) Appl. No.: 09/618,791

(22) Filed: Jul. 18, 2000

(51) Int. Cl.[7] ..... B41F 27/12
(52) U.S. Cl. ..... 101/415.1; 101/378
(58) Field of Search ..... 101/415.1, 378, 101/383, 385, 386, 409

(56) References Cited

U.S. PATENT DOCUMENTS 4,376,414 A * 3/1983 Burger et al. ..... 101/415.1
5,396,843 A * 3/1995 Durr ..... 101/415.1
5,485,784 A * 1/1996 Walschlaeger, Sr. ..... 101/415.1

* cited by examiner

*Primary Examiner*—Leslie J. Evanisko
(74) *Attorney, Agent, or Firm*—Edgar W. Averill, Jr.

(57) ABSTRACT

A printing plate lockup mechanism for use in a cylinder groove of a plate cylinder. The lockup mechanism has a base plate which is held in the cylinder groove and has cutouts which permit grippers to be held by the base plate. Thrust bars take the place of conventional thrust cylinders and each thrust bar is held above a base plate by a pair of springs. Plate locating clips are also held on the base plate. The lockup mechanism of the present invention permits the conversion from a mechanical lockup system to a snap-in tooless system. It also permits the securement of downsized printing plates so that plates of a lesser width can be accommodated on printing cylinders originally designed for plates of a wider width. The printing plate lockup of the present invention can be used to replace a mechanical lockup system. The mechanical lockup system is removed from the plate cylinder and the new tooless system installed in its place.

7 Claims, 6 Drawing Sheets

PRINTING PLATE LOCKUP MECHANISM

BACKGROUND OF THE INVENTION

The field of the invention is offset printing and the invention relates more particularly to printing presses used for printing newspapers or other large volume printing presses. The presses are designed to use paper of a certain width. Because of the high cost of paper, it has long been known that a substantial savings in paper costs can be accomplished by printing newspaper of a smaller width. The cost of retrofitting a cylinder so that it can hold plate grippers more closely spaced has been very expensive, both because of press down time and labor costs. Also, many presses have lockup mechanisms which are worn or otherwise deficient and there is a need for an improved plate lockup mechanism which can be retrofitted efficiently.

BRIEF SUMMARY OF THE INVENTION

It is an object of the present invention to provide a printing plate lockup mechanism which can be efficiently retrofitted in an existing cylinder of a printing press.

The present invention is for a printing plate lockup mechanism for use with any web width, including width cut downs for attachment in a cylinder groove of a plate cylinder. The groove has a floor into which holes have previously been drilled and tapped for holding the original printing plate lockup mechanism. This is usually located in a removable bar described as a filler bar on most cylinders. Rather than drilling and tapping any new holes, a base plate is secured against the groove 4 or onto a replaced filler bar with correct hole positioning. The base plate has a plurality of gripper pivot rod grooves, a plurality of plate gripper cutouts and a plurality of base securement screw openings. A plurality of plate grippers are held on gripper pivot rods positioned in the sets of gripper pivot rod grooves. The pivot rods are held in the pivot rod grooves by rod retainers which are held by screws which are either screwed into the original drilled and tapped screws or in threaded openings in the base plate, or onto a replaced filler bar. A plurality of thrust bars are used which have radius domes held and positioned by guide members held in openings in the base plate. A pair of springs are held against the underside of the domes and against the groove floor to bias the plate grippers against the inwardly angled flanges of the plate cylinder groove. The plate locating clips bridge the cylinder groove to allow rotation in either direction. They may be positioned for any plate size and may be adjustable for changes in web width and are mounted to the base plate.

DESCRIPTION OF THE PREFERRED EMBODIMENTS

Figure 1:
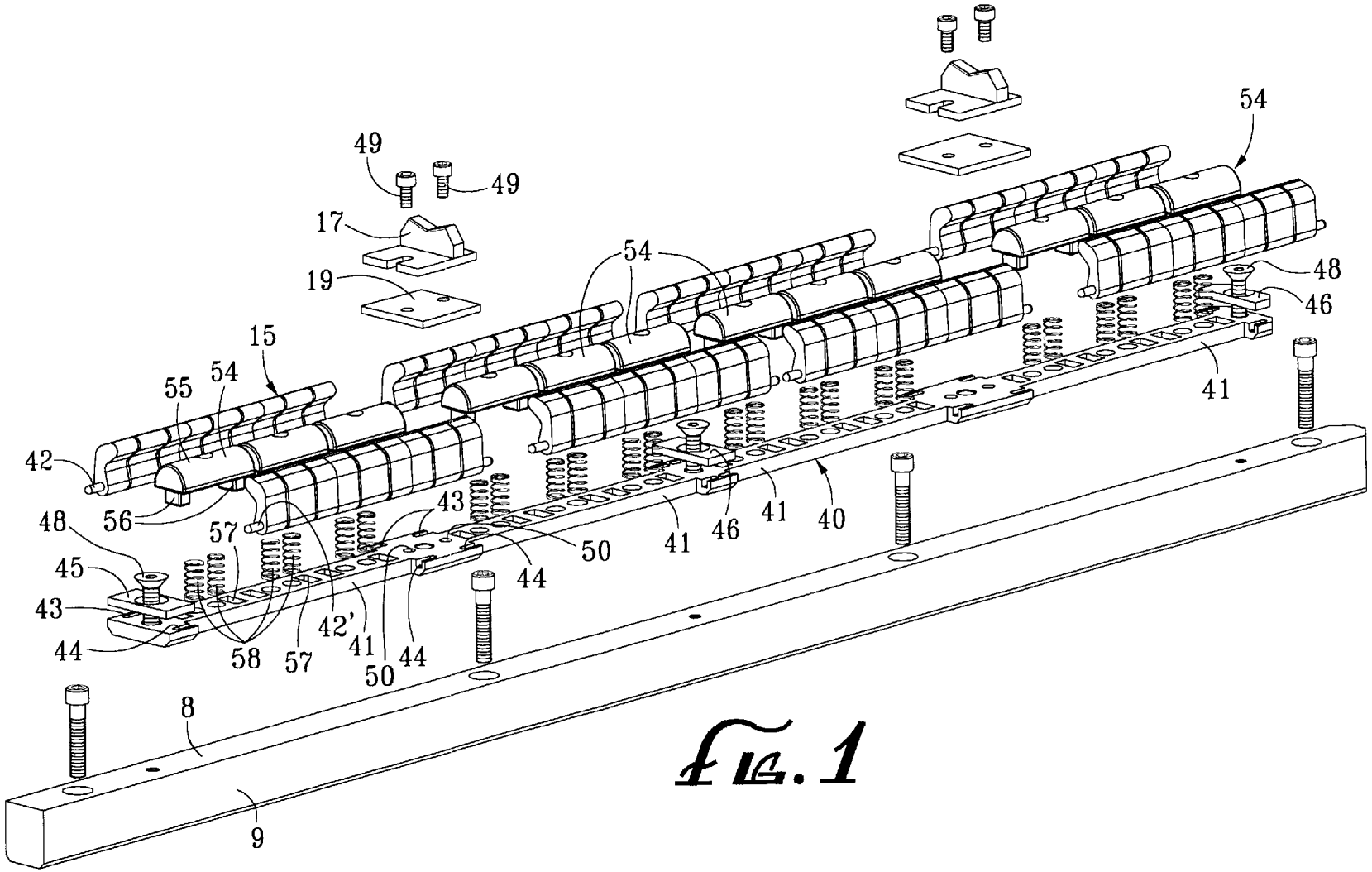
FIG. 1 is an exploded perspective view of the printing plate lockup mechanism of the present invention.
Figure 2:
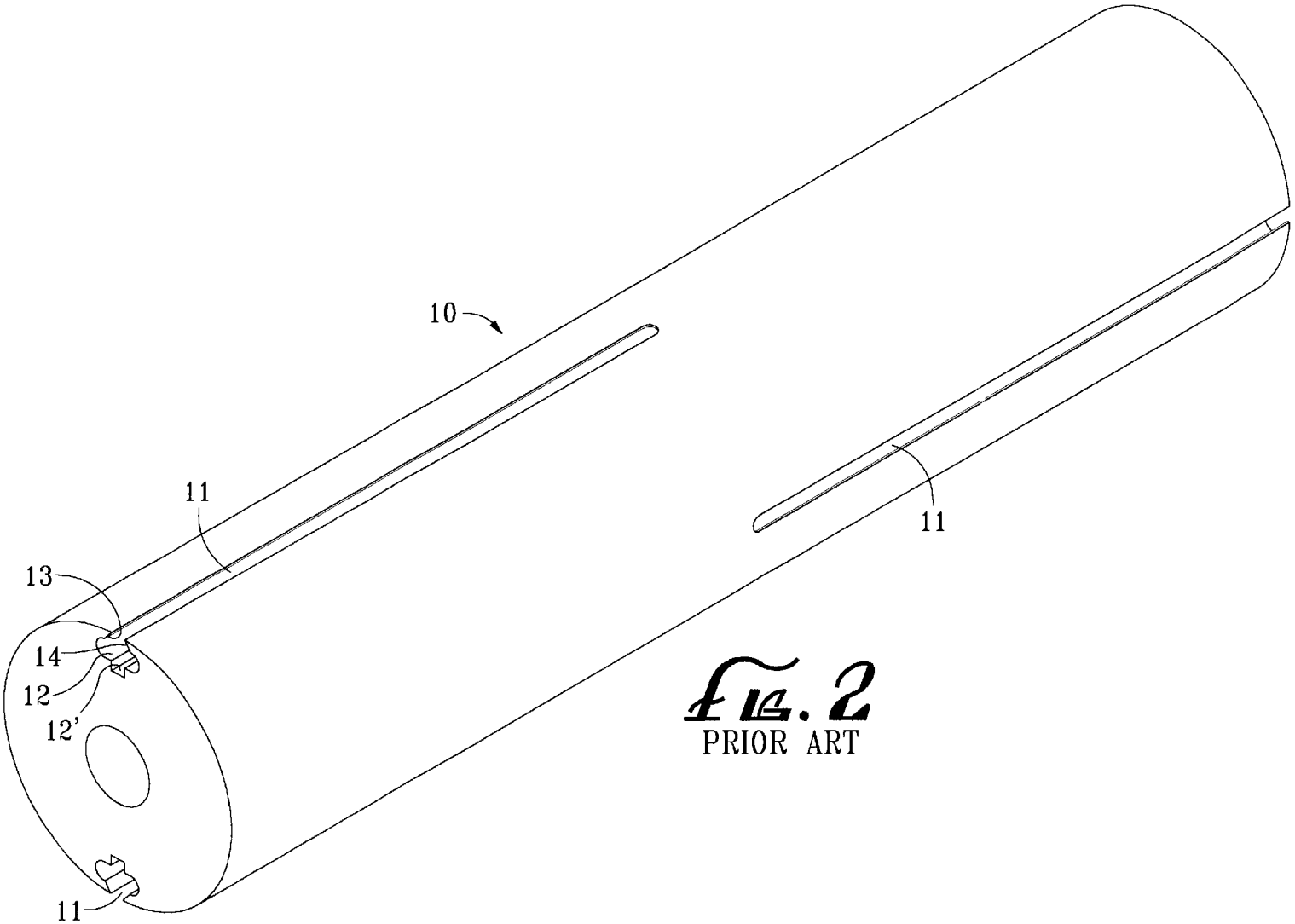
Fig. 2 PRIOR ART
FIG. 2 is a perspective view of a conventional plate cylinder having two sets of offset grooves.

A conventional plate cylinder 10 is shown in FIG. 2 and has two pairs of grooves 11 which are offset 180° between members of a pair and 90° between pairs. Groove 11 has a groove floor 12. Groove floor 12 may include a recess 12' in which a filler bar 9 (shown in FIG. 1) may be secured. The upper surface 8 of filler bar 9, thus, becomes part of groove floor 12. When the term "secured to the groove floor" is used, it is intended to mean that it is either directly screwed into the groove floor or into the filler bar which is held in the groove floor. Groove 11 also has a pair of inwardly angled flanges 13 and 14. Photo etched aluminum printing plates, such as those shown in FIG. 3 and indicated by reference characters 25 and 26, are held against the inwardly angled flanges by sets of plate grippers 15 shown in FIGS. 1 and 9.

Figure 3:
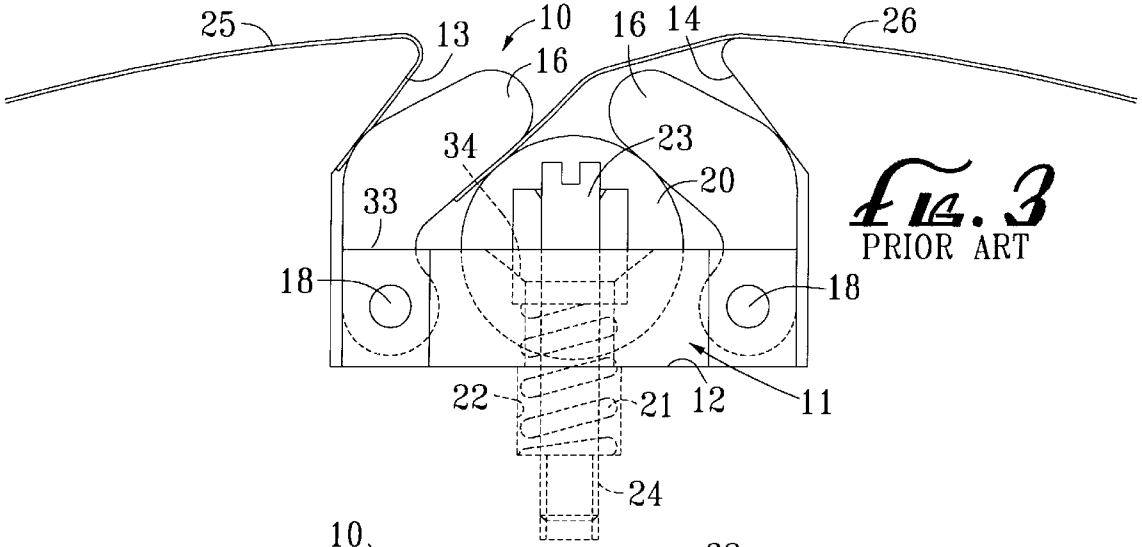
Fig. 3 PRIOR ART
FIG. 3 is a cross-sectional view of a prior art printing plate lockup mechanism showing the floating biased thrust cylinders and plate grippers.
Figure 4:
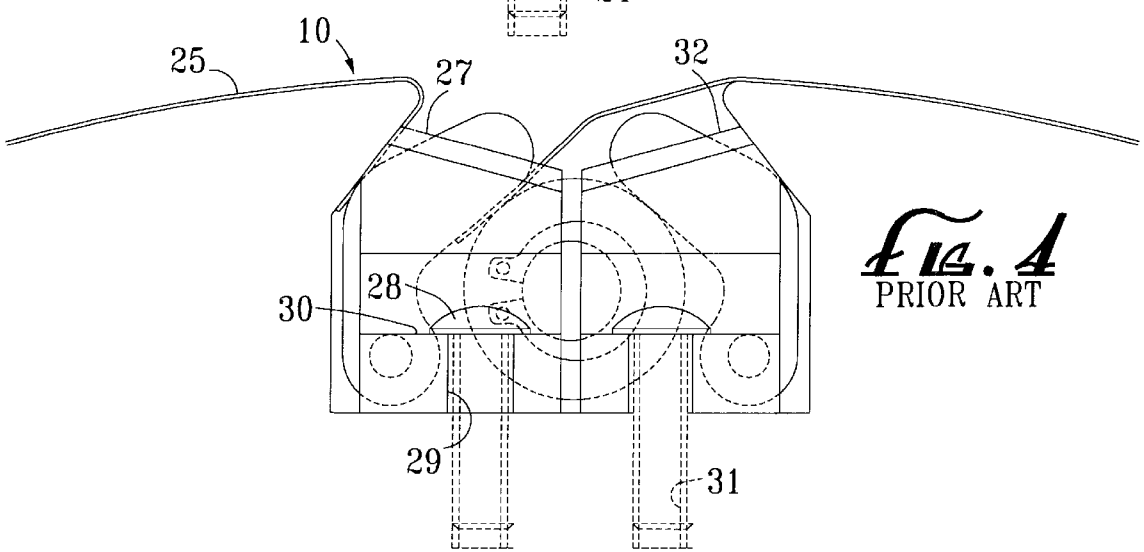
Fig. 4 PRIOR ART
FIG. 4 is a cross-sectional view of a prior art printing plate lockup mechanism showing the plate locating clips.
Figure 5:
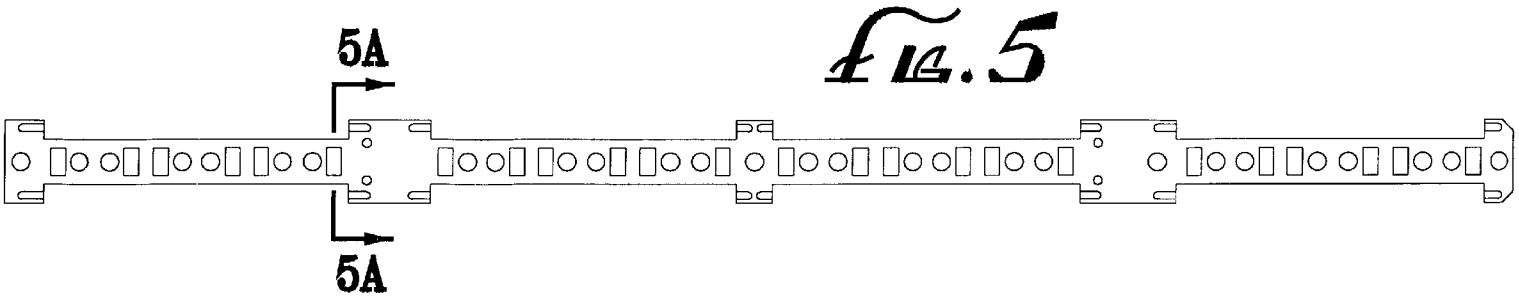
FIG. 5 is a top view of a typical base plate of the present invention.

A prior art plate gripping mechanism is shown in cross-sectional view in FIGS. 3 and 4. Other plate gripping mechanisms are also commonly used and may also be used with the present mechanism. Plate cylinder 10 of FIG. 3 has a groove 11 with a groove floor 12. Groove 11 has a pair of inwardly angled flanges 13 and 14 analogous shown in FIG. 2. A pair of plate grippers 16 are held by gripper pivot rods 18. They are urged upwardly by a floating thrust cylinder 20 which is biased upwardly against the underside of plate grippers 16. Thrust cylinder 20 is urged upwardly by thrust cylinder springs 21 held against the bottom of a stepped spring recess 22. The thrust assembly comprising thrust cylinder 20 and thrust springs 21 are held by a cylindrical screw 23 which is screwed into a threaded blind opening 24 which is drilled and tapped into groove floor 12 of plate cylinder 10, or in the upper surface 8 of filler bar 9.

In this way, the photo etched aluminum printing plates 25 and 26 may be installed into the groove 11. Printing plate 25 is held against angled flange 13 by the upper surface of plate gripper 16. Printing plate 26 is held between the floating biased thrust cylinder 20 and the underside of plate gripper 16. This lockup system is reversible in that printing plate 26 may be held against angled flange 14 by the upper surface of the second plate gripper 16 shown in FIG. 3. Printing plate 25 is then held between the floating biased thrust cylinder 20 and the underside of plate gripper 16. Because the cylinder 20 floats somewhat, it permits the insertion and removable of the printing plates which keeping a spring pressure on the plates and the gripper. As the plate cylinder 10 is rotated, the gripping force increases due to the centrifugal force of the mass of cylinder 20.

Gripper pivot rods 18 are held in a pair of pivot rod support blocks, one of which is shown in FIG. 3 and indicated by reference character 33. Block 33 is held against the groove floor 12 by a screw which, in turn, is held by a threaded opening in groove floor 12 not shown. A screw head abuts counter sunk opening 34 shown in phantom view in FIG. 3.

The printing plates are accurately position by mating slots in the printing plate with a plate locating clip 27. Plate locating clip 27 is held by clip screws 28 which pass through clip flange opening 29 and clip flange 30. Screws 28 are threaded into drilled and tapped threaded clip flange screw openings 31. A second plate locating clip 32 is not used with the plates positioned as they are shown in FIG. 4, this being used for reverse rotation.

In order that printing plates of a smaller width be accommodated in the groove of the existing plate cylinder 10, many of the pre-drilled and tapped openings are used. Thus, it can be seen that the plate grippers and locating clips are held by screws which pass directly into blind threaded openings in plate cylinder 10 or in openings formed in filler bar 9.

A normal way of substituting plates of a smaller size would be to simply drill and tap new openings in groove floor 12 or in filler bar 9 and place grippers in a different position. Unfortunately, this takes an immense amount of labor on a mounted high speed printing press because of the large number of grooves and the difficulty in threading and tapping openings in grooves 11. The present invention does away with drilling and tapping and instead uses a base plate such as base plate 40 shown in FIG. 1. Base plate 40 has plate gripper cutouts 41 which permit the pivoting arc of the plate grippers to be accommodated. The plate grippers 15 are essentially the same as plate grippers 16, but may have a modified profile. Gripper rods 42 and 42' are held in gripper pivot rod grooves 43 and 44. They are retained in grooves 43 and 44 by a series of cover plates, including the first end base plate 45 and either by a register clip 17 and shim 19 or by similar retainers 46. Thus, the base plate 40 is held against the groove floor 12 or against the upper surface of filler bar 9 by several base securement screws 48. In contrast, the register clip 17 is held in place by screws 49 which are not threaded into the floor 12, but instead, are threaded into threaded openings 50 in base plate 40. The clip retaining screws 49 are loosened and the register clip 17 may be moved side to side to the exact desired location. Then screws 49 are tightened.

Figure 6:
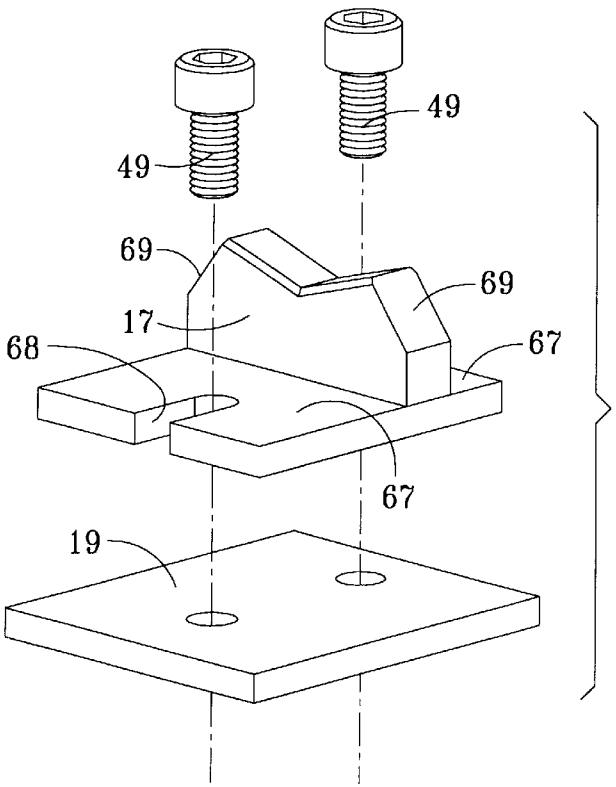
FIG. 6 is a perspective view of a plate locating clip used with the present invention.
Figure 5A:
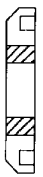
FIG. 5A is a cross-sectional view taken along line 5A—5A of FIG. 5.
Figure 7:
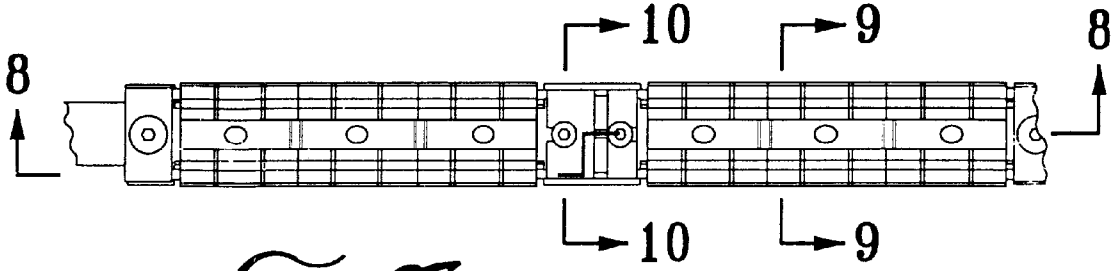
FIG. 7 is a top view of the assembled printing plate lockup mechanism of FIG. 1.
Figure 8:
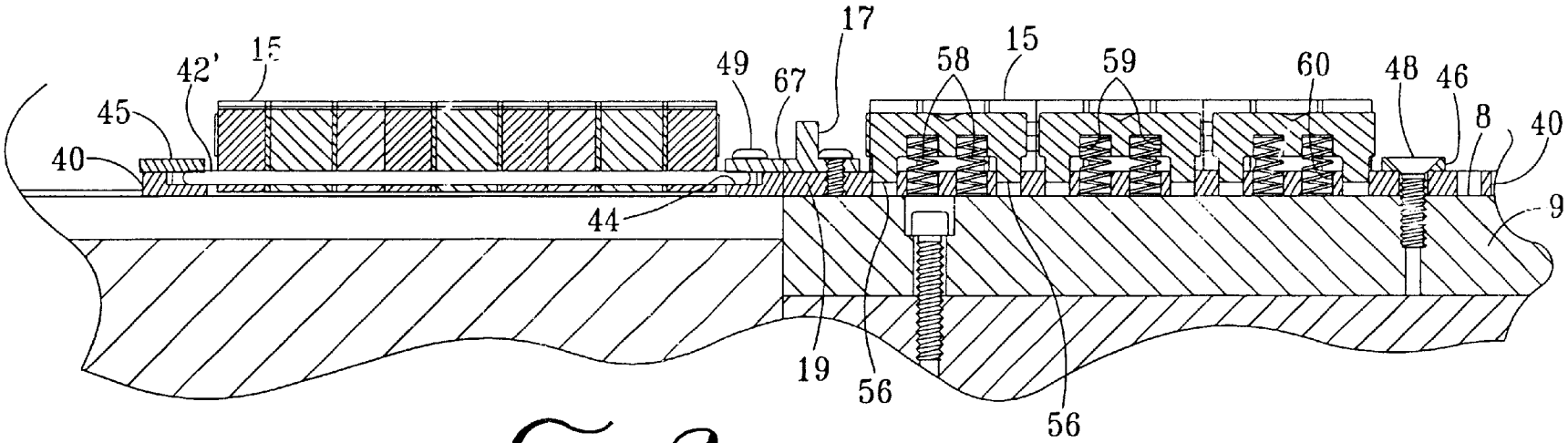
FIG. 8 is a cross-sectional side view taken along FIG. 8—8 of FIG. 7.
Figure 10:
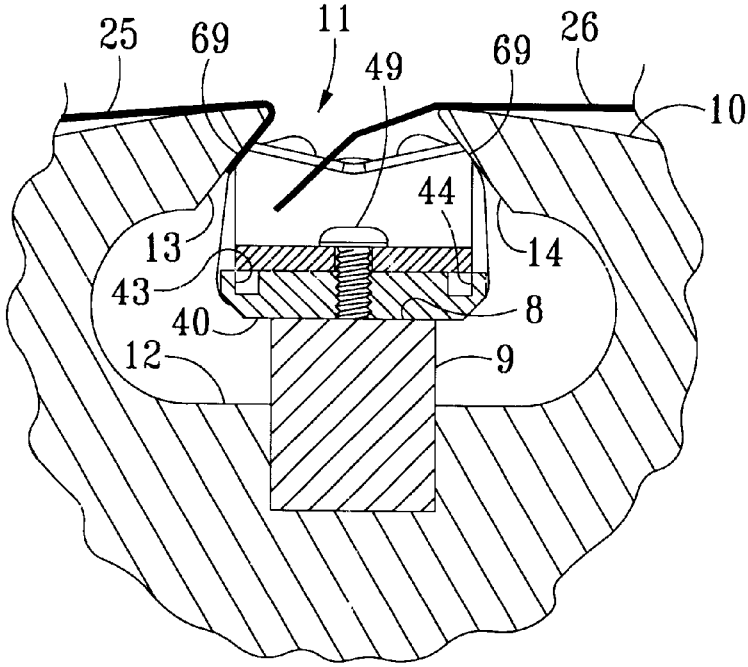
FIG. 10 is a cross-sectional view taken along line 10—10 of FIG. 7.

The details of the register clip 17 are shown in perspective view in FIG. 6. Clip 17 has a bottom flange 67 which includes a pair of adjustment slots 68. The height of installation of register clip 17 may be adjusted in several ways and one simple adjustment is by the selection of a positioning shim 19 of appropriate thickness. A pair of flange contacting faces 69 are positioned by shim 19 so that they abut inwardly angled flanges 13 and 14 of groove 11. This is shown best in FIG. 10. As can be seen in FIG. 8, flange 67 of plate locating clip 17 retains gripper rods 42' in pivot rod groove 44.

The result of the use of register clip 17 with two flange contacting faces 69 permits the use of printing plates installed from either direction.

Figure 9:
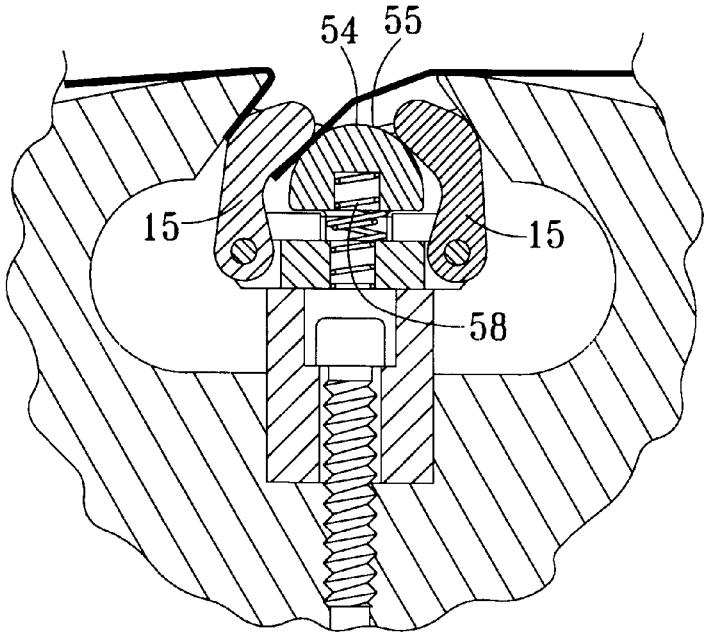
FIG. 9 is a cross-sectional view taken along line 9—9 of FIG. 7.

Thrust bars 54 shown in FIG. 1 and shown in cross-sectional view in FIG. 9 each have a cyclindrical portion or domed top 55 which subtends an arc of about 180° and two guide members 56. Guide members 56 fit in oversized openings 57 in base plate 40. Each thrust bar 54 has a pair of helical springs 58 shown best in FIG. 8. These springs 58 rest against the upper surface 8 of filler bar 9 which forms a part of groove floor 12. Springs 58 also rest against recesses 59 in thrust bars 54. The springs 58 pass through openings 60 in base plate 40.

To complete the securement of base plate 40 against the groove floor 12 (or the upper surface 8 of filler bar 9). The end result is an assembly which can easily be secured into the existing groove of plate cylinder 10 without the necessity of drilling any additional holes at all in the floor 12 or in the filler bar 9. By using a pair of springs for each thrust bar, the thrust bar is evenly urged against the underside of plate grippers 15. The assembly of the present invention permits the gripper pivot rods to be removed and reinstalled by merely removing a pair of rod retaining plates 46 without the necessity of removing the base plate 40. The assembly permits the utilization of some of the existing parts of the prior art lockup mechanism and requires no special fastening hardware. The register may be easily adjusted by loosening screws 49 and sliding the bottom flange 67 and then tightening the screws 49 in adjustment slots 68. Because of the use of dual springs in the thrust bar 54 and the play between the guide members 56 and the openings 57, the result is providing a similar gripping force on the underside of the plate grippers on both side of the thrust bars. The design of the present invention provides less chance of component damage if objects or debris move between the lockup and adjacent blanket cylinder or when a paper wrap occurs around the plate or blanket cylinders. The man hours required to retrofit a new lockup device is greatly reduced as compared to that required for installation of some prior art mechanisms. The design supercedes many current lockup devices and provides exceptionally long life and durability.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A printing plate lockup mechanism for attachment in a cylinder groove of a plate cylinder which groove has a groove floor, a groove floor length and a pair of inwardly angled flanges, said mechanism comprising:

a base plate capable of being secured to the groove floor, said base plate having a plurality of gripper pivot rod grooves and a plurality of guide openings;

a plurality of gripper pivot rods held in said plurality of gripper pivot rod grooves;

a plurality of rod support blocks held to said base plate;

a set of plate grippers held on said gripper pivot rods held in said gripper pivot rod grooves by said rod support blocks, each of said plate grippers having an underside;

a set of floating biased thrust bars floatingly secured in said guide openings formed in said base plate and each of said set of floating biased thrust bars having at least one thrust spring which urges each of said bars upwardly against said underside of each of said plate grippers so that the plate grippers are adapted to hold a photo etched printing plate between one of said plate grippers and the inwardly angled flanges formed against at least one edge of said groove; and a set of plate locating clips adjustably held against said base plate.

2. The printing plate lockup mechanism of claim 1 wherein said plate locating clips each have a bottom flange having slotted openings in a bottom flange portion thereof so that said base plate locating clips may be adjustably secured to the base plate.

3. The printing plate lockup mechanism of claim 2 further comprising clip retaining screws, wherein said plate locating clips are held to said base plate by said clip retaining screws and said base plate has threaded openings for holding said clip retaining screws.

4. The printing plate lockup mechanism of claim 1 wherein said at least one thrust spring comprises a pair of helical springs.

5. The printing plate lockup mechanism of claim 1 wherein said set of floating biased thrust bars each have a pair of guide members affixed thereto which guide members are rectangular tabs and said base plate has rectangular openings larger than said rectangular tabs so that said thrust bars are permitted some side to side and longitudinal movement.

6. The printing plate lockup mechanism of claim 1 wherein said biased thrust bars have a cylindrical portion which subtends an arc of about 180°.

7. The printing plate lockup mechanism of claim 1 wherein said plate locating clips each have a pair of flange contacting faces.

* * * * *